United States Patent [19]

Scheiderer

[11] Patent Number: 4,628,655

[45] Date of Patent: Dec. 16, 1986

[54] ARRANGEMENT FOR SEALING GLASS PANES IN WOODEN WINDOW OR DOOR LEAVES

[76] Inventor: Norbert Scheiderer, Austrasse 16, 8534 Wilhermsdorf, Fed. Rep. of Germany

[21] Appl. No.: 678,714

[22] Filed: Dec. 6, 1984

[30] Foreign Application Priority Data

Dec. 7, 1983 [DE] Fed. Rep. of Germany ..... 3344268

[51] Int. Cl.[4] ..... E04B 1/62

[52] U.S. Cl. ..... 52/397

[58] Field of Search ..... 52/126.1, 126.3, 126.6, 52/202, 205, 209, 211–214, 397–400, 474–476, 769, 822, 823, 824

[56] References Cited

U.S. PATENT DOCUMENTS

| | | | |
|---|---|---|---|
| 3,221,453 | 12/1965 | Lietaert | 52/209 |
| 3,394,044 | 7/1965 | Bright | 52/716 |

FOREIGN PATENT DOCUMENTS

| | | | |
|---|---|---|---|
| 1784215 | 7/1971 | Fed. Rep. of Germany | 52/400 |
| 2157655 | 5/1973 | Fed. Rep. of Germany | 52/397 |
| 2440459 | 7/1980 | France | 52/716 |
| 628893 | 11/1961 | Italy | 52/476 |
| 7906289 | 2/1981 | Netherlands | 52/397 |
| 440651 | 12/1967 | Switzerland | 52/398 |
| 623104 | 5/1981 | Switzerland | 52/397 |
| 1102045 | 2/1965 | United Kingdom | 52/716 |
| 1282531 | 7/1972 | United Kingdom | 52/208 |

OTHER PUBLICATIONS

Deventer GmbH & Co., Profildichtung aus eleastischem Material für Fenster, Paneele und dergleichen, Sep. 1982, pp. 1566, 1577, GM8215352.

*Primary Examiner*—John E. Murtagh

[57] ABSTRACT

In a sealing arrangement for glass panes in wooden window or door leaves, in which the glass pane arranged in the window frame is supported on the outside of the frame against a glass rebate chamfer and on the inside of the frame against a glass retaining strip, while interposing an elastic strand seal in each case, the inside of the glass rebate chamfer also facing its frame opening is provided with an all-round web projecting there and over which is slipped a profile projection provided on the outer strand seal and which completely engages over the same in such a way that it also elastically presses against the outer face of the all-round web which is remote from the glass pane. The inner strand seal has a banana-shaped sealing section whose convexity, on fitting, is directed towards the glass retaining strip and is braced between the latter and the glass pane.

20 Claims, 4 Drawing Figures

ARRANGEMENT FOR SEALING GLASS PANES IN WOODEN WINDOW OR DOOR LEAVES

BACKGROUND OF THE INVENTION

The invention relates to an arrangement for sealing glass plates or panes in wooden window or door leaves or wings, whereby the glass pane arranged in the leaf frame is supported on the outside of the frame against a glass rebate chamfer and on the inside of the frame against a glass retaining strip, whilst in each case interposing an elastic strand seal.

In the construction of wooden window glazing systems, it has been known to place elastic putty between the outer faces of the window panes to be glazed and the inner faces of the associated glass rebate chamfer and said putty must be highly adhesive due to the desired good sealing action. However, for applying such putty it was necessary to force the same out of cartridges, tubes, etc into the gap between the glass pane surface and the surface of the inside of the glass rebate chamfer or glass retaining strip facing the glass. It was then necessary to smooth the surface of the putty layer introduced in this way, in order to give a clean appearance thereof in the finished frame. However, it was scarcely possible to avoid the glass pane and/or lined frame from becoming smeared with putty, it then being difficult to remove the smears. Moreover, in the case of careless joining together, leaks can occur within the putty layer due to cavities, which could prejudice the desired sealing action. Relatively difficult operating stages would be required if it was subsequently necessary to replace the glass pane in such a wooden window glazing system. Thus, the entire frame is covered with adhesive material on its inside in the vicinity of the putty joint, so that it must firstly be cleaned after removing the previously used pane, e.g. by means of a knife or the like, so as to remove the still present sealing compound. However, glass could be broken on disassembling the existing window pane if the removal of the sealing compound was not carried out with adequate care and despite the removed putty, the glass was still secured in position by putty residues.

Instead of using elastic putty, attempts have also already been made to use prefabricated other seals. However, the need has arisen with the hitherto used weather seals to provide recesses or grooves on the surfaces of the glass retaining strip or the glass rebate chamfer facing the glass pane, which once again led to the risk of undesired entry of moisture into such depressions. However, in this case, the penetrated moisture could not be removed again, leading to wetting of the wood and consequently to fungoid growth, tne destruction of the wood and other disadvantageous consequences.

German Utility Model No. 8,215,352 discloses a weatherseal, which does not require such recesses or grooves in the glass retaining strip or glass rebate chamfer. However, this known weatherseal is only intended for the inside of the window, i.e. for introduction between the window pane and the glass retaining strip, because it is not self-supporting and would otherwise fall out before introduction of the pane. Although this known weatherseal does not require the making of a groove, relief-milling in the glass retaining strip is necessary. This once again leads to relatively high labour costs in producing the glass retaining strip. Although the tolerance compensation is satisfactory in a sealing arrangement using such a weatherseal on the inside of the window, this is not always adequate when larger tolerances occur.

SUMMARY OF THE INVENTION

Therefore, the problem of the present invention is to so improve an arrangement for sealing glass panes in window or door leaves made from wood of the aforementioned type, that there is no need for any undercuts, grooves or other depressions on the surfaces of the glass retaining strip and the glass rebate chamfer facing the window pane, whilst simultaneously ensuring an excellent, operationally reliable sealing action against moisture and always permitting a particularly simple and rapid assembly or disassembly of the pane.

According to the invention, this is achieved in connection with a sealing arrangement of the aforementioned type in that on its inside facing the frame opening, the glass rebate chamfer is provided with an all-round web proJecting there and over which is slipped a profile projection completely overlapping the all-round web and provided on the outer strand seal in such a way that it is elastically pressed against the outer face of the all-round web remote from the glass pane and the inner strand seal has a cross-sectionally roughly banana-shaped sealing section in the relieved state and whose convexity is directed towards the glass retaining strip in the fitted state and between the glass retaining strip and the glass pane is braced in such a way that at least a portion of the rear surface of the convexity engages on the glass pane.

The sealing arrangement according to the invention permits an extremely simple and rapid assembly or disassembly of such wooden window glazing systems, without it being necessary to use specially trained personnel. The outer weatherseal is firstly placed on the blind frame with the glass rebate chamfer, in that its projecting, all-round profile projection is slipped over the corresponding all-round web on the glass rebate chamfer. This brings about a perfect fit and a completely satisfactory mounting of the weatherseal on the glass rebate chamfer, although the window frame is not fitted. When the outer weatherseal has been placed in the frame, the window pane to be sealed is then introduced into the latter (the term window pane and glass pane obviously representing no restriction to the use of a single pane and instead the pane assembly to be installed is to be considered as an entity and consequently covers the case of multiple or insulating glazing consisting of a number of individual panes). After inserting the glass pane, the glass retaining strip is fixed and into the gap formed between the strip and the inner surface of the window pane is forced from above the banana-shaped sealing section of the weatherseal. The banana-shaped curvature of the inner strand seal makes it possible to compensate relatively large tolerances without difficulty, because such a banana-shaped sealing section has a relatively large lateral projecting length, which is reduced to the dimension of the gap on introducing into the latter between the pane and the glass retaining strip. The all-round profile projection on the outer profile or weatherseal and which engages round and behind from the inside to the outside the all-round web (nose) projecting from the inside of the glass rebate chamfer, not only brings about the aforementioned fixing effect which so facilitates the assembly of the complete arrangement, but also very effectively prevents undesired penetration of moisture. Thus, for moisture to penetrate, it would be necessary for the moisture to be able to penetrate between the elastically pressed profile projection and the all-round web, which is virtually impossible in view of the small dimensions of such a web, the relative contact pressure between the elastic profile projection and the surfaces of the web and whilst taking account of the repeated considerable direction changes necessarily arising through the outer contours of the small web profile. Thus, the moisture would also have to be able to overcome an upwardly directed surface between the elastically pressed profile and the glass rebate chamfer and consequently advance "uphill" between an elastically pressed part and a fixed part, which also virtually completely prevents moisture entry. The adapted construction of the outer all-round web and the projection on the weatherseal completely engaging over and round the same consequently gives a combinatory effect both with regards to facilitated fitting (holding effect of the inserted seal on the glass rebate chamfer even before fitting the glass pane) and regarding a particularly effective prevention of penetration of moisture (excellent sealing action), which is very important in sealing panes in wooden windows or doors (wetting, fungoid growth).

The combination of the inventive features solves the problem of the invention in a surprisingly simple and effective manner. The interaction of the inner seal with a banana-shaped sealing section and the outer seal, together with the interaction between the outer seal and the all-round web on the glass rebate chamfer leads to a very advantageous overall arrangement and it is only the interaction of all the individual features which leads to the overall effect of a particularly simple construction, together with rapid, simple assembly, excellent sealing action, very good tolerance compensation and excellent functionality.

An advantageous development of the sealing arrangement according to the invention comprises the profile projection on the outer strand seal engaging in substantially U-shaped manner over the all-round web (viewed cross-sectionally), which not only represents a simple shaping, but also leads to a particularly favourable sealing and holding action.

A particularly favourable pressing behaviour of the elastic profile projection with respect to the outer faces of the all-round web can be obtained in that the profile projection (once again considered cross-sectionally) overlapping the all-round web has substantially the same thickness over its entire length. This ensures that even in the vicinity of its free end, the profile projection can still be pressed with a relatively good elastic pressing force against the outer face of the all-round web there.

A further improvement to the sealing action can be obtained in that in a sealing arrangement according to the invention, a profile projection is provided on its sides facing the all-round web with projecting longitudinal ribs. Thus, on elastically pressing the profile projection against the all-round web, pressure peaks are produced at the tips of the longitudinal ribs when pressing the same which effectively prevent moisture penetration, especially when several such ribs are provided.

According to another advantageous development of the present sealing arrangement, the outer strand seal is provided on its outer face facing the glass rebate chamfer (i.e. in the vicinity of the sealing gap between the glass pane and said chamfer) with projecting longitudinal ribs. This leads to an increased holding effect within the sealing gap, together with an improved sealing effect relative to the penetration of moisture from the outside.

It is particularly advantageous in connection with the aforementioned provision of longitudinal ribs, if they are cross-sectionally sawtooth-shaped, said ribs being preferably arranged in zig-zag manner (viewed in the longitudinal direction of the weatherseal). In addition, such longitudinal ribs are advantageously parallel to one another.

A particularly preferred construction of the present sealing arrangement is obtained in that the profile projection completely covers the outside of the all-round web. This means that the all-round web projecting from the glass rebate chamfer is overlapped or covered completely by the profile projection, including on its side located on the outside of the glass rebate chamfer, so that the complete outer contour of the web is covered by the profile projection in the form of an elastically pressing "cap".

A further improvement to the sealing action on the outside of the window can be obtained in that in the base area of the profile projection is additionally provided a packing washer directed from the strand seal against the glass pane and which is pressed in sloping manner against the latter in the fitted state. This essentially refers to the point of the outer strand sealing from which the profile projection projects outwards for covering the all-round web. Thus, the outwardly projecting profile projection passes here into an inwardly projecting packing washer, i.e. it is pressed in sloping manner due to the elastic deformation onto the outer surface of the window. This not only leads to an improved sealing action, but also to an optically more pleasing appearance (the profile projection covering the all-round web in cap-like manner on the outside passes continuously into a packing washer directed towards the inside).

A further particularly preferred embodiment of the invention consists of the outer strand seal having on its inside facing the glass pane at least one projection as a stop for the latter, apart from the elastically deformable packing washers and preferably two such projections serving as stops are provided, one of which (viewed in the cross-section of the seal) is positioned roughly level with the profile projection for covering the all-round web on the glass rebate chamfer, whilst the other is positioned in the vicinity of the other end of the weatherseal. In simple manner, this leads to the important advantage that there is not only a precisely defined assembly stop for the glass pane on inserting the latter during assembly on the outside, but also prevents the remaining packing washers applied by the outer strand seal against the glass pane surface from being excessively deformed, so that no undesired squeezing of the packing washers can occur, which increases the sealing action.

According to another preferred embodiment of the invention, the inner strand seal has on its side facing the glass retaining strip a sealing projection which, in the fitted state, presses against the inner edge of said strip facing the same and covers the latter. Through a simple construction of the inner strand seal, it is ensured that during the assembly thereof, namely when inserted from above into the open sealing gap between the glass pane and the glass retaining strip, the sealing projection leads to a type of "stop" so that it cannot accidentally be inserted too deeply into the sealing gap. There is simultaneously an improved sealing action relative to the inside of the room by covering the inner edge of the glass retaining strip by means of the sealing projection.

A further advantageous development of the sealing arrangement according to the invention consists of the inner strand seal having in the extension of its banana-shaped sealing section an inner packing washer, whose inner face facing the glass pane is pressed over its entire length against the said pane in the fitted state and whose outer face passes into that of the sealing projection. This also leads to a particularly pleasing optical appearance of the complete upper slot covering on the inside of the wooden window or door, whilst also very effectively improving the sealing action on the inside of the room.

A further advantageous embodiment of the invention consists of providing in the vicinity of the banana-shaped sealing section of the inner strand seal hollow chambers directed in the longitudinal direction of the strand within said inner sealing section. This makes it possible to desirably influence the elasticity of the banana-shaped sealing section and the tolerance compensation can also be improved if such inner hollow spaces are suitably arranged.

It is pointed out that when constructing the outer strand seal with profile projections provided on its inside facing the glass pane and which serve as stops for the latter, the tolerance compensation of the complete sealing arrangement can exclusively take place via the inner strand seal, because as a result of the stops on the outer strand seal the pressing position of the glass pane is precisely fixed there and any tolerances present exclusively occur on the inner sealing gap between the glass pane on the inside of the window and the glass retaining strip, so that they are compensated solely by the inner strand seal. Particularly from this respect, the banana-shaped construction of the sealing section on the inner strand seal is particularly suitable for compensating the tolerance occurring there. However, as a result of this weatherseal, there is not only a tolerance compensation with regards to the sealing function, but also a tolerance compensation with respect to the elastic bracing of the window pane within the overall arrangement between the two strand seals, whilst completely ensuring the desired firm fit of the glass pane. Thus, within the overall arrangement, the special construction of the inner strand seal embraces the action of a tolerance compensation both with regards to the sealing function and as regards to the bracing and holding action of the fitted glass pane.

According to a further preferred embodiment of the invention, outside the banana-shaped sealing section on the inner strand seal in the end area thereof covered by the glass retaining strip, additionally obliquely projecting packing washers are provided which press against the inner face of the glass retaining strip, which leads to an overall improvement to the sealing action certain improvements also occurring regarding the retaining or holding action exerted on the pane.

According to another preferred development of the invention, reinforcing inserts are provided in the area of the banana-shaped sealing section within the inner strand seal, so that when such reinforcing inserts are suitably arranged and when using suitable reinforcing materials, there is a specific "spring characteristic" on elastically squeezing the sealing section.

In the case of the sealing arrangement according to the invention, advantageously the outer strand seal is constructed in such a way that in the relieved state it has a profile cross-bar, on whose one end (viewed in the profile cross-section) a profile projection is provided on one side, which projects at an acute angle obliquely to the profile cross-bar and is provided on its end with a short nose projecting approximately at right angles towards the cross-bar. In addition, the profile projection in its base area on the cross-bar passes into a packing washer projecting on the other side of the cross-bar in an extension of the profile projection. On this side directly below the packing washer and at the other end of the cross-bar, is provided thereon a projection having a stop face for the glass pane and between the two projections a further sloping packing washer projecting at an obtuse angle to the cross-bar. With respect to the use of such a strand seal within a sealing arrangement according to the invention, this construction of the outer strand seal provides a particularly favourable weatherseal configuration, which not only has the aforementioned stops for the glass pane, but also ensures through the special construction of the profile projection that on installation the all-round web to be covered by the profile projection is always contacted by the latter, accompanied by elastic pretensioning.

Thus, through a suitable combination of individual elements, the sealing arrangement according to the invention not only provides a simpler construction and a very good permanent sealing action but also easy assembly or disassembly with respect to the window pane, without it being necessary to use specially trained personnel and without long and tedious work being necessary. Practical testing has revealed that the sealing arrangement according to the invention can be fitted or removed much more rapidly than known sealing arrangements. The advantage of using prefabricated weatherseals is combined with the advantage of particularly clean working during assembly, as well as glazing repairs which can be carried out without problems and without high labour costs an any time and which could not hitherto be achieved in combined manner in wooden window glazing systems.

BRIEF DESCRIPTION OF THE DRAWINGS

The invention is described in greater detail hereinafter relative to non-limitative embodiments and the drawings, wherein show.

DETAILED DESCRIPTION OF THE PREFERRED EMBODIMENTS

Figure 1:
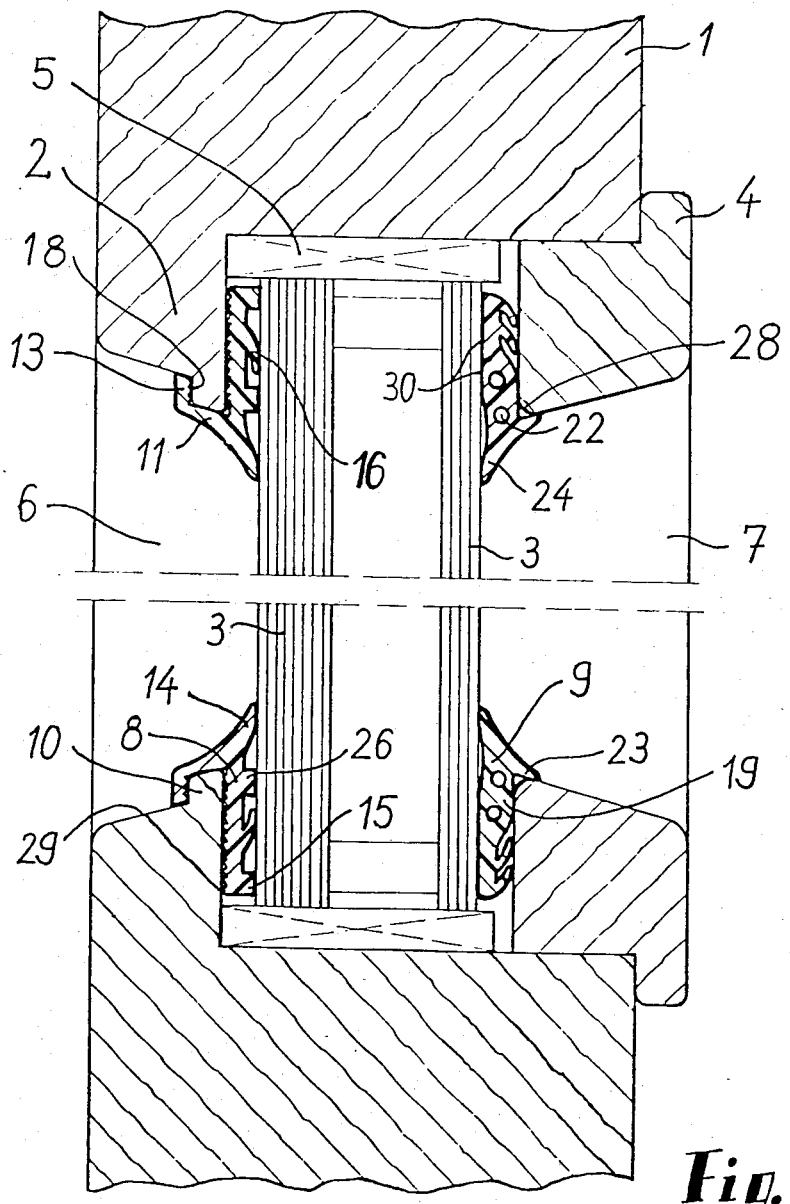
FIG. 1 a sectional representation of a sealing arrangement according to the invention when fitted in a wooden window.

FIG. 1 shows a cross-section through a sealing arrangement according to the invention, fitted in a wooden window. The outside of a window frame 1 is provided with a projecting glass rebate chamfer 2. Within window frame 1 is housed a glass pane assembly which, in the represented embodiment, is constructed as insulating double glazing with two glass panes 2, which is supported by means of blocks 5 with respect to frame 1.

An outer strand seal 8 is provided between the insulating glazing 3 and the projecting glass rebate chamfer 2, whilst an inner strand seal 9 is arranged between the insulating glazing 3 and the glass retaining strip 4. The glass surface of the insulating glazing 3 resting on the outside of the window is supported on profile stops 15, 26 projecting inwards towards glass pane 3 on the outer strand weatherseal 8, so that their position relative to the glass rebate chamfer 2 is accurately fixed by the stops of the outer strand seal 8.

Figure 3:
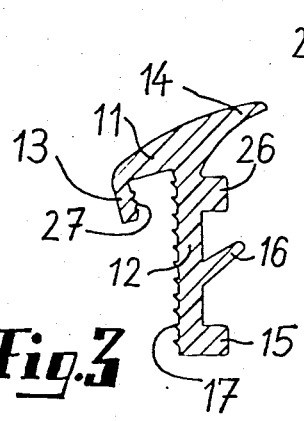
FIG. 3 an outer strand seal according to the invention (in cross-section and in the relieved state).

On its side directed towards the outside of frame 1, the outer strand seal 8 has a profile projection 11 which, as shown in FIG. 3, projects obliquely to the profile cross-bar 12 (of FIG. 3) at an acute angle in the relieved state of the outer seal 8 and is provided on its outer end with a short nose 13 directed towards the cross-bar 12 under an acute angle and which is bent at approximately right angles thereto. On its outside (i.e. the left-hand frame side in FIG. 1), window frame 1 comprises a frame opening 6 and the glass retaining strip 4 embraces on the opposite frame side an opening 7. The glass rebate chamfer 2 forming the boundary of frame opening 6 on the outside of window frame 1, has on its all-round inner edge facing the outer glass pane 3 (i.e. the edge at which the inner lateral face of the glass rebate chamfer 2 facing the outer glass pane 3 passes into the radially outer limiting surface 29 of outer frame opening 6 for forming the latter) a small all-round web 10 projecting towards the frame opening 6 and which is covered by the profile projection 11 of the outer strand seal 8, as well as the outer nose 13 provided thereon in the form of a cap. The length of nose 13 of profile projection 11 is selected in such a way that it completely covers the outer lateral face 18 (i.e. the outer face of all-round web 10 remote from the outer glass pane 3) and its end face engages against the circumferential surface 29 which radially outwardly defines opening 6. The profile shape of the outer strand seal 8 (of FIG. 3) in the relieved state is selected in such a way that although the shape of profile projection 11 and its nose 13 are essentially adapted to the shape of web 10, but as is shown in FIG. 3 the rest position of profile projection 11 and nose 13 of outer profile seal 8 is selected in such a way that in the fitted state, i.e. on covering web 10, it undergoes elastic pretensioning. Thus, it can be seen from FIG. 1 that the outer lateral face 18 and the inner lateral face of all-round web 10 facing the outer glass pane 3 are substantially parallel to one another in the represented embodiment, whilst as shown in FIG. 3 the weatherseal of the outer seal 8 in the relieved state has no parallelism of nose 13 and cross-bar 12, cf FIG. 3. In fact, nose 13 is inclined at a shallow angle to cross-bar 12, the angle being selected in such a way that in the fitted state (cf FIG. 1) there is a corresponding elastic pressing force of nose 13 against the outer face 18 of all-round web 10. The same applies regarding profile projection 11 which, in its rest state, also has a smaller angle to its cross-bar 12 than during subsequent installation (FIG. 1). As a result, in the complete covering area, i.e. in the complete engagement surface between profile projection 11 and nose 13 on the one hand and the corresponding outer faces of web 10 on the other, there is an elastic pressing of the profile of outer seal 8 against the web 10 in the fitted state. As can be seen in FIG. 3, longitudinal ribs 27 are provided on the inside of nose 13 and longitudinal ribs 17 are provided on the outside of cross-bar 12. Thus, in the fitted state, pressure peaks occur at the corresponding contact points due to the elastic pressing, which better prevents a penetration of moisture from the outside through the seal, because said moisture would pass between sealing profile 11 and nose 13 on the one hand and the all-round web 10 on the other and would have to travel "uphill".

Apart from the aforementioned stops 15 and 26 on the side of the outer strand seal 8 facing the outer glass pane 3, there are also sloping packing washers 16 between the two stops 15 and 26.

Profile projection 11 passes into a packing washer 14 which slopes towards the outer glass pane 3 (cf also FIG. 3), which in the fitted state (cf FIG. 1) is also elastically bent by the outer glass pane 3 and engages with the latter under elastic pressure.

Complete inner terminating part of the outer weatherseal 8, which comprises packing washer 14, profile projection 11 and outer covering nose 13, represents a closed, optically attractive and extremely effective sealing means at the particular end of cross-bar 12, profile projection 11 and nose 13 preventing the undesired penetration of moisture between the weatherseal and all-round web 10, whilst packing washer 14 and packing washers 16 prevent a penetration of moisture directly over the outer surface of the outer glass pane 3.

Due to the fact that the outer seal 8 is clipped over the all-round web 10 on the glass rebate chamfer 2 by means of profile projection 11 and nose 13, it is also ensured that during the fitting of the complete arrangement a particularly simple and rapid assembly or disassembly is ensured. Thus, before the glass pane 3 is inserted in the opening within the window frame 1, the outer strand seal 8 is fitted by placing it over the all-round web 10 in the aforementioned manner. This not only subsequently prevents the undesired penetration of moisture but, prior to the insertion of glass pane 3, ensures that the fitted outer strand seal 8 has a firm assembly fit. When the outer strand seal 8 has been fitted, the glazing, such as the exemplified insulating double glazing with two glass panes 3 is inserted. The glass retaining strip 4 is then fitted from the inside of window frame 1 and is secured. The inner strand seal 9 is then inserted into the sealing gap between the inner glass pane 3 and the inner lateral face of glass retaining strip 4.

Figure 4:
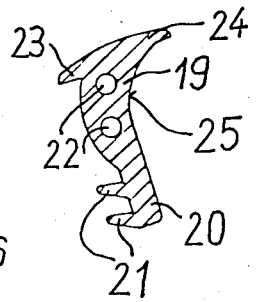
FIG. 4 an inner strand seal according to the invention (in cross-section and in the relieved state).

In the rest state, the inner strand seal has a profile, as shown e.g. in FIG. 4. It is important that it has a sealing section 19 which is bent in roughly banana-shaped manner. The latter is understood to mean a round convexity which, as shown in FIG. 4, the curvature of the profile axis of the profile cross-section in said area has a continuously decreasing convexity radius. As tests have shown, such a banana-shaped convexity gives the best results. However, in some cases, completely satisfactory results can even be obtained with purely arcuate curvatures. The banana-shaped convexity required in connection with the inner strand seal is therefore intended to indicate that it need not be a purely arcuate curvature and that the term also particularly covers curvatures with a varying convexity radius.

The inner strand seal 9, after fitting the window pane 3 and glass retaining strip 4, is then inserted from the side of opening 7 into the gap formed between strip 4 and glazing 3. As is shown in FIG. 4, a small projecting nose 23 is fitted to the end of the convexity section 19 on the side of seal 9 facing the glass retaining strip 4 and this serves as a stop and alignment aid on inserting the strand seal 9 into said gap. The seal is inserted until nose 23 engages with the inner edge 28 of the glass retaining strip 4. On inserting the seal 9 into the said gap, the convex sealing section 19 of the inner strand seal 9 is deformed between inner pane 3 and the inner lateral face of glass retaining strip 4 facing the same in the sense of reducing the convexity and as a result a pretension is produced which braces the double glazing both between the outer strand seal 8 and the inner strand seal 9. All the tolerances which are to be compensated are compensated through the elasticity of the curved sealing section 19 of the inner strand seal. However, as shown in FIG. 4, it is advantageous to thicken the convex section 19 of the inner strand seal 9, so that it is able to apply the necessary pretensioning and supporting forces for glazing 3.

To the sealing section 19 of the inner strand seal 9 is connected a base part 20, which is provided with packing washers 21 on its side facing the glass retaining strip 4 and these are also elastically deformed on inserting the inner seal 9 into said gap and, under elastic pretensioning, come into sealing contact with the inside of the glass retaining strip 4.

During the deformation of convex section 19 during fitting, its inner convex face 25 facing glass pane 3 is brought into a constantly less convex position with increasing deformation. Due to the deformation and bracing effect which occur, said face 25 of the banana-shaped section 19 is completely engaged with the facing outer face of glass pane 3 at least over a portion thereof, as indicated by reference numeral 30 in FIG. 1. It can be seen that in the indicated fitted state, a complete engagement on glass pane 3 has taken place over the entire base area and up to approximately half the convex section. As can be seen in FIGS. 1 and 4, within convex section 19 there are hollow chambers 22 extending in the longitudinal profile direction and these enable suitable influencing of the reinforcing behaviour of section 19. As shown in FIGS. 1 and 4, there can be one or two or more such hollow chambers and their cross-sectional profile can be constructed in accordance with the particular requirements round, oval, kidney-shaped, etc). In certain special cases, it can be advantageous to fit e.g. synthetic fibres (particularly glass or carbon fibres) in place of or in addition to said hollow chambers. All suitable elastic sealing materials can be used for both the outer and the inner strand seal, it being particularly advantageous to make the seals from foamed material. It is advantageous to have a completely closed, thin sealing outer skin, whilst only providing a foamed material in the interior.

As shown in FIGS. 1 and 4 in connection with the inner strand seal 9 the small nose 23 passes continuously into a packing washer 24 sloping against the glass pane 3 and which is applied to the latter under elastic pressure.

Figure 2:
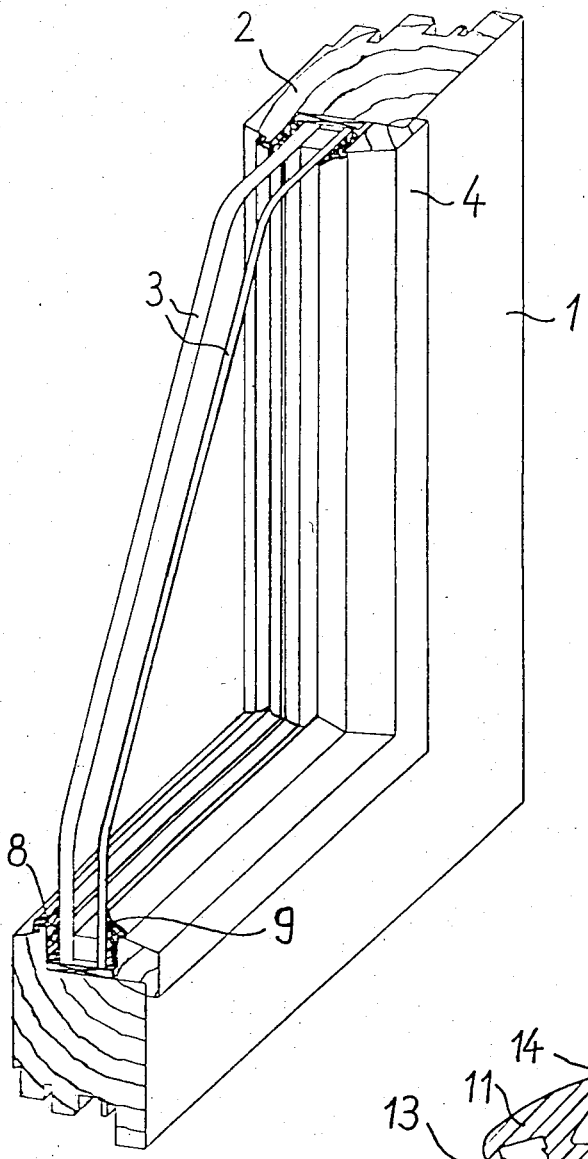
FIG. 2 a part sectional perspective view of a sealing arrangement according to the invention in a wooden window.

FIG. 2 shows a part-sectional perspective view of a window with the sealing arrangement according to the invention. It is possible to see window frame with the glass rebate chamfer 2, the window panes 3 arranged in frame 1 and the glass retaining strip 4 fitted from the inside of the frame. Between the glass rebate chamfer 2 and the outer window panes 3 is provided the outer strand seal 8 and between the inner window pane 3 and the glass retaining strip 4 the inner strand seal 9 in the fitted state. The drawing makes it particularly clear that the described sealing arrangement leads to a particularly attractive external overall appearance.

Although the present sealing arrangement has been described relative to the example of a wooden window, it can also be used in connection with a door having an inserted window or other wooden leaves, in such window panes are to be sealingly fitted.

The sealing arrangement according to the invention makes it possible to simply and rapidly install glazing systems in wooden windows or doors, so as to ensure reliable sealing against the entry of moisture, even when particularly large installation tolerances occur. Prefabricated weatherseals can be inserted, without it being necessary to mill undercuts or grooves on the sides of the glass retaining strip or glass rebate chamfer facing the glass surfaces. The invention reliably and permanently prevents the entry of even the smallest amounts of moisture, which are the cause of serious problems in connection with wooden windows and doors.

What is claimed is:

1. An arrangement for sealing a glass pane in a wooden frame opening defined by a plurality of peripherally extending sections of said frame, at least one section comprising a glass rebate chamfer on an outside portion of said frame and at least another section comprising a glass retaining strip on an inside portion of the frame and serving as an inner boundary for said frame opening, said glass pane being disposed in said wooden frame opening between the glass rebate chamfer and said glass retaining strip and spaced from each of the rebate chamfer and strip to define a first space between the glass rebate chamber and one side of the glass pane and a second space between an opposite side of the glass pane and said glass retaining strip, the improvement residing in that the frame includes a radially directed surface, serving as an outer boundary for said frame opening, peripherally bounding said glass rebate chamfer and extending outwardly therefrom in a direction away from said one side of the glass pane, said radially directed surface in cross section being a generally smooth surface excepting for its inner end portion adjacent said one side of the glass pane whereat said surface is stepped out of a plane containing said smooth surface to define a protruding web, said web having an inner portion which merges with a wall delimiting said glass rebate chamfer facing and generally parallel to said one side of said glass pane, said web protrusion from said radially directed surface being small compared to an overall extend of the merged inner end of said web with said delimiting wall of the glass rebate chamfer, a first elastic strand seal in said first space and having a profile projection overlapping said web in form of a cap, said profile projection having an end face engaging a portion of said radially directed surface adjacent said web and being elastically pressed against a face of said stepped web remote from the glass pane, a second elastic strand seal in said second space having a sealing section having a convexity of essentially banana-shape in cross-section in its unmounted state and being disposed in said second space with its convexity toward the glass retaining trip so that when thus mounted pretensioning forces are applied by the second elastic strand seal against said opposite side of said glass pane for bracing said glass pane in said wooden frame.

2. An arrangement according to claim 1, wherein the profile projection engages said protruding web in substantially U-shaped manner, viewed in cross-section.

3. An arrangement according to claim 1, wherein the profile projection engaging said protruding web, considered in cross-section, has substantially the same thickness over its entire length.

4. An arrangement according to claim 1, wherein the profile projection on its sides facing said protruding web, is provided with projecting longitudinal ribs.

5. An arrangement according to claim 1, wherein said first elastic strand seal is provided on its outer face facing the glass rebate chamfer with projecting longitudinal ribs.

6. An arrangement according to claim 4 wherein the longitudinal ribs cross-sectionally have a sawtooth shape.

7. An arrangement according to claim 5, wherein the longitudinal ribs are arranged in zig-zag manner in the longitudinal direction of the strand.

8. An arrangement according to claim 4 wherein the longitudinal ribs are parallel to one another.

9. An arrangement according to claim 1, wherein the profile projection completely covers the outside of said protruding web.

10. An arrangement according to claim 1, wherein in the base area of the profile projection is provided a packing washer directed from the first elastic strand seal against said one side of the glass pane, said packer washer pressing obliquely against said one side of the glass pane in the fitted state.

11. An arrangement according to claim 1, wherein said first elastic strand seal on its inside facing said one side of said glass pane has at least one projection as a stop for the glass pane and elastically deformable packing washers.

12. An arrangement according to claim 11, wherein two projections are provided as stops, one of which, considering the cross-section of said first lastic strand seal, is arranged essentially level with said profile projection, an other of said stops being positioned in the vicinity of the outer end of said first strand seal.

13. An arrangement according to claim 1, wherein the second elastic strand seal has a sealing projection on its side facing the glass retaining strip and which in its fitted state is pressed against an inner edge of the glass retaining strip facing said opposite side of the glass pane.

14. An arrangement according to claim 1, wherein in the extension of its banana-shaped sealing section, said second elastic strand seal has an inner packing washer, whose inner face facing said opposite side of the glass pane is elastically pressed over its entire length against said glass pane, its outer face merging into that of the sealing projection.

15. An arrangement according to claim 1, wherein hollow chambers are provided in the vicinity of the banana-shaped sealing section within said second elastic strand seal and running in the longitudinal direction thereof.

16. An arrangement according to claim 1, wherein additional obliquely projectin elastic sealing lips, pressing against an inner face of the glass retaining strip, are provided outside the banana-shaped sealing section in an end area of said second elastic strand seal which is covered by the glass retaining strip.

17. An arrangement according to claim 1, wherein reinforcing inserts are provided within said second elastic strand seal in the vicinity of the banana-shaped sealing section.

18. An arrangement according to claim 1, wherein in the relieved state, said first elastic strand seal has a profile cross-bar at one end of which, viewed in the profile cross-section, said profile projection projects to one side of the profile cross-bar at an acute angle relative thereto, said profile projection being provided at its end with a short nose directed toward the cross-bar and projecting from the profile projection at approximately right angles thereto, said profile projection in its central region, whereat it merges with the cross-bar, passing into and merging with a packing washer at an opposite side of the cross-bar, there being further provided on the profile cross-bar, directly below the packing washer, and on the other end thereof a projection, each projection having a stop face for the glass pane, an additional packing washer, sloping at an obtuse angle to the cross-bar, being provided between the projection below the packing washer and that at the other end of the cross-bar.

19. An arrangement according to claim 1, wherein said first elastic strand seal is made from foamed plastic with a thin closed outer skin.

20. An arrangement according to claim 1, wherein the second elastic strand seal is made from foamed plastic with a thin closed outer skin.

* * * * *